US005491310A

United States Patent [19]

Jen

[11] Patent Number: 5,491,310

[45] Date of Patent: Feb. 13, 1996

[54] ACOUSTIC BOARD

[76] Inventor: Wang H. Jen, P.O. Box 82-144, Taipei, Taiwan

[21] Appl. No.: 301,648

[22] Filed: Sep. 7, 1994

Related U.S. Application Data

[63] Continuation-in-part of Ser. No. 568,029, Aug. 16, 1990, Pat. No. 5,004,070, and a continuation-in-part of Ser. No. 906,424, Jun. 30, 1992, Pat. No. 5,185,504.

[51] Int. Cl.[6] ..... E04B 1/82

[52] U.S. Cl. ..... 181/286; 181/288; 181/292; 181/293

[58] Field of Search ..... 181/284, 286, 181/288, 287, 292, 293, 295, 290

[56] References Cited

U.S. PATENT DOCUMENTS 3,819,007 6/1974 Wirt et al. ..... 181/293

4,600,078 7/1986 Wirt ..... 181/286

*Primary Examiner*—Khanh Dang

*Attorney, Agent, or Firm*—Alfred Lei

[57] ABSTRACT

An acoustic board including a front panel formed with a plurality of large openings and small openings, a rear panel having a distance from the front panel, an intermediate panel fitted between the front panel and the rear panel thereby forming a front chamber between the front panel and the intermediate panel and a rear chamber between the intermediate panel and the rear panel and having a plurality of large holes and small holes, and a plurality of sound collecting devices each including a conical hood, a cover, an outer housing and a front silencer, whereby the noise can be effectively isolated from one side to another.

2 Claims, 4 Drawing Sheets

ACOUSTIC BOARD

CROSS-REFERENCE

This application is a continuation-in-part of Ser. No. 568,029, filed Aug. 16, 1990, now U.S. Pat. No. 5,004,070 and a continuation in part of Ser. No. 906,424, filed Jun. 30, 1992, now 5,185,504, owned by the same inventor.

BACKGROUND OF THE INVENTION

It has been found that various conventional acoustic boards have been developed to meet the increasing need of isolating a noise from one side to the other. However, some are too bulky in volume and difficult to construct while others are too expensive for most people.

Therefore, it is an object of the present invention to provide an acoustic board which may obviate and mitigate the above-mentioned drawbacks.

SUMMARY OF THE INVENTION

This invention relates to an improved acoustic board.

It is the primary object of the present invention to provide an acoustic board which can effectively isolate the noise from one side to another.

It is another object of the present invention to provide an acoustic board which is compact in size.

It is still another object of the present invention to provide an acoustic board which is economic to produce.

It is still another object of the present invention to provide an acoustic board which is easy to construct.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
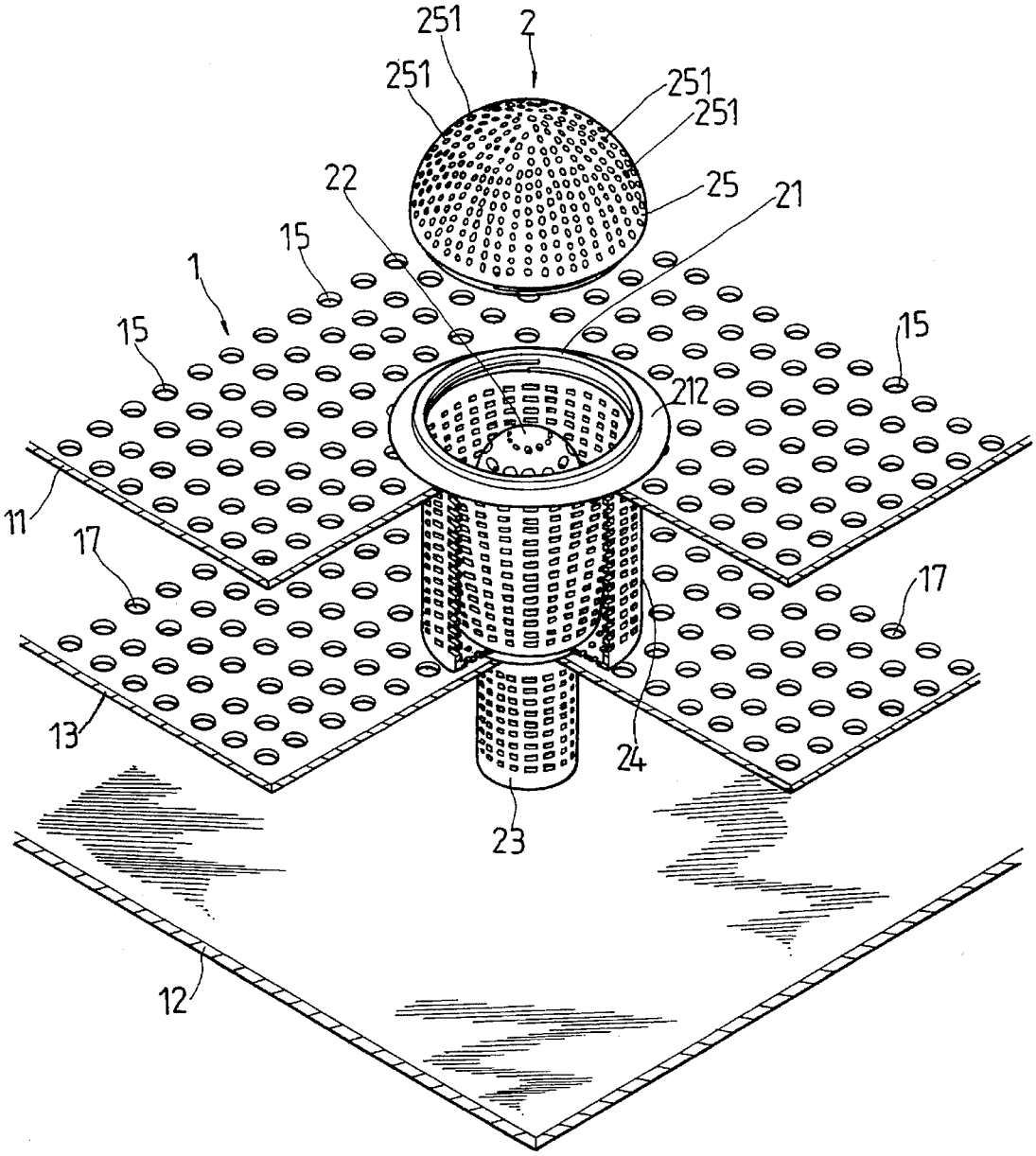
FIG. 1 is a cutaway perspective view of an acoustic board according to the present invention.
Figure 2:
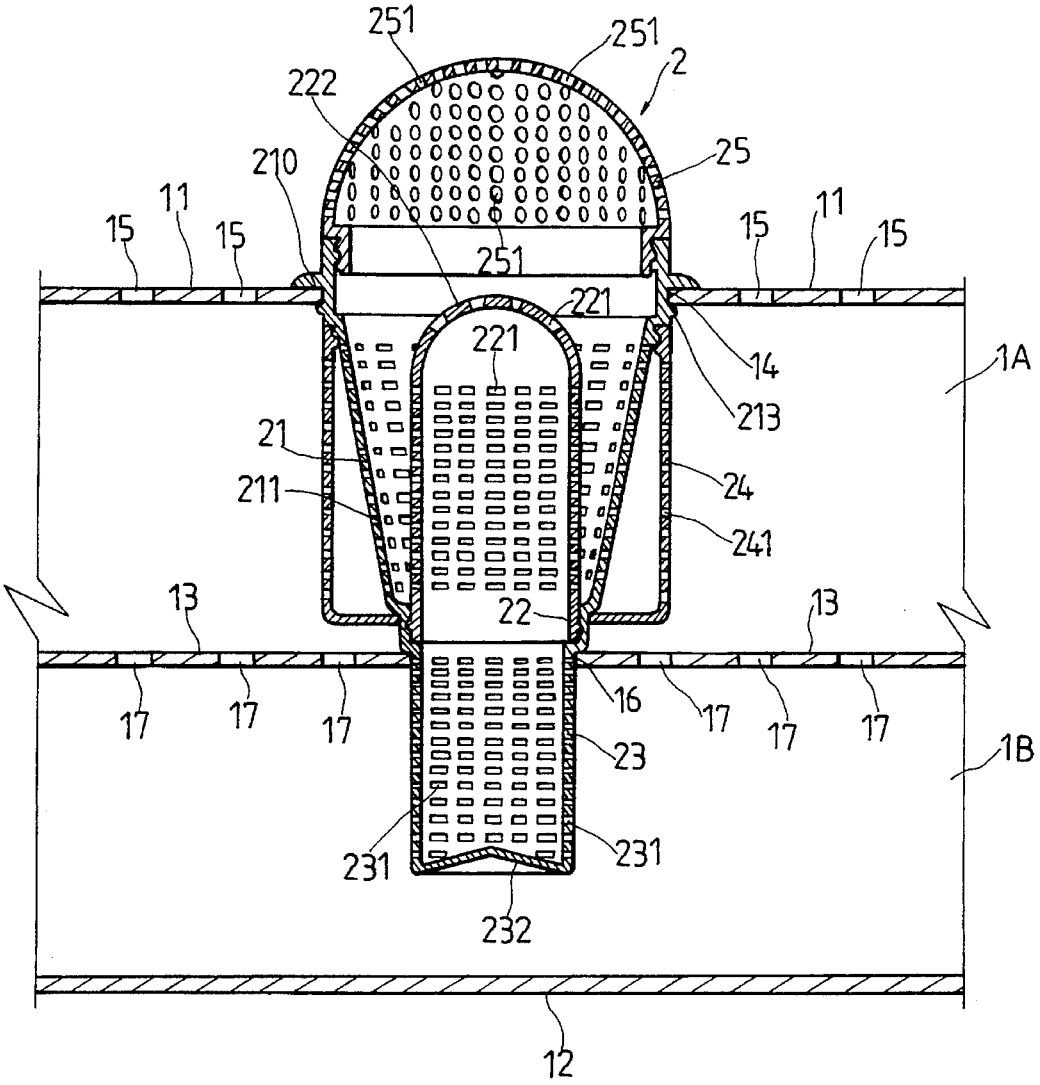
FIG. 2 is a sectional view of the acoustic board.

With reference to the drawings and in particular to FIGS. 1 and 2 thereof, the acoustic board according to the present invention mainly comprises a front panel 11, an intermediate panel 13, a rear panel 12, and a plurality of sound collecting devices 2.

The front panel 11 has a distance from the rear panel 13. The intermediate panel 13 is positioned between the front panel 11 and the rear panel 12 thereby forming a front chamber 1A between the front panel 11 and the intermediate panel 13 and a rear chamber 1B between the rear panel 12 and the intermediate panel 13. The front panel 11 is formed with a plurality of large openings 14 (only one of them is shown) and small openings 15. The intermediate panel 13 has a plurality of large holes 16 (only one of them is shown) and small holes 17. The large openings 14 of the front panel are aligned with respective large holes of the intermediate panel 13. The rear panel 12 is simply a flat member. Further, acoustic absorption material may be filled into the front and rear chambers 1A and 1B as required.

The sound collecting device 2 includes a conical hood 21, a cover 25, an outer housing 24, and a front silencer. 22. The conical hood 21 has a plurality of perforations 211 and is formed at the large end with an annular groove 210 adapted to engage the large opening 14 of the front panel 11. Further, the conical hood 21 is provided at the small end with a rear silencer 23 which has a plurality of perforations 231 and extends through the large hole 16 of the intermediate panel 13 into the rear chamber 1B. The rear silencer 23 is formed with a conical end 232 and has a plurality of perforations 231. The outer housing 24 is a cylindrical member having a plurality of perforations 241 and fitted over the conical hood 21 within the front chamber 1A. The cover 25 is threadedly engaged with the large end of the conical hood 12 and has a plurality of perforations 251. The front silencer 22 is fitted within the conical hood 21 and positioned on the rear silencer 23. In addition, the front silencer 22 has a hemispherical end 222 and formed with a plurality of perforations 221.

When in use, the noise first passes through the perforations 251 of the cover 25 into the conical hood 21. Then, part of the noise will pass through the perforations 211 of the conical hood 21 and the perforations 241 of the outer housing 24 into the front chamber 1A, while the remaining part of the noise will pass into the front silencer 22 through the perforations 222. Thereafter, the noise in the front chamber 1A will pass through the perforations 17 of the intermediate panel 13 into the rear chamber 1B, while the remaining part of the noise will pass through the perforations 231 of the rear silencer 23 into the rear chamber 1B. Further, the sound unable to be collected by the sound collecting device will first pass through the perforations 15 of the front panel 11 into the front chamber 1A and then through the perforations 17 of the intermediate panel 13 into the rear chamber 1B. The working principle of the sound collecting device is that the sound will be compressed and expanded when passing through the perforations 211, 221, 231, 241 and 251 thereby largely decreasing the noise in magnitude and therefore effectively isolating the noise from one side to another.

Figure 3:
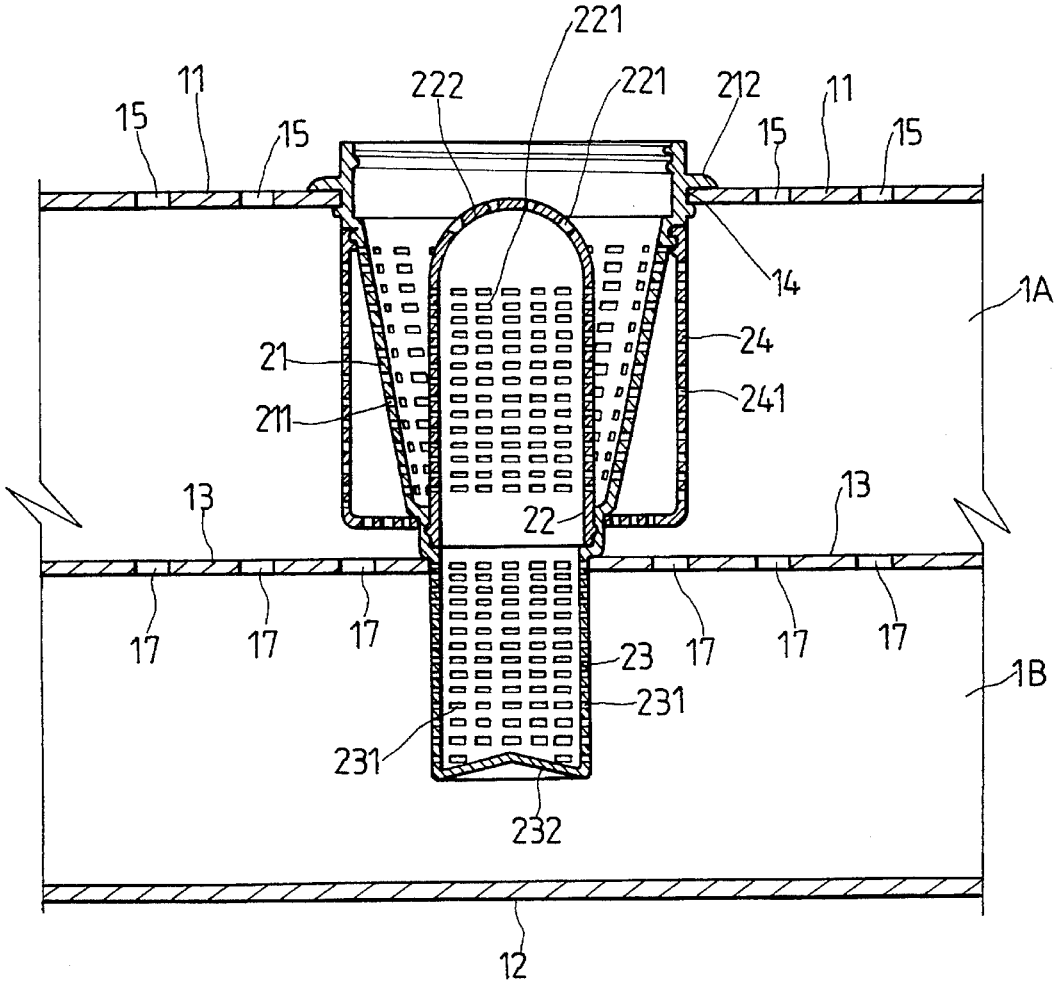
FIG. 3 is a sectional view of a second preferred embodiment according to the present invention.

FIG. 3 shows a second preferred embodiment of the present invention wherein the cover 2 is omitted.

Figure 4:
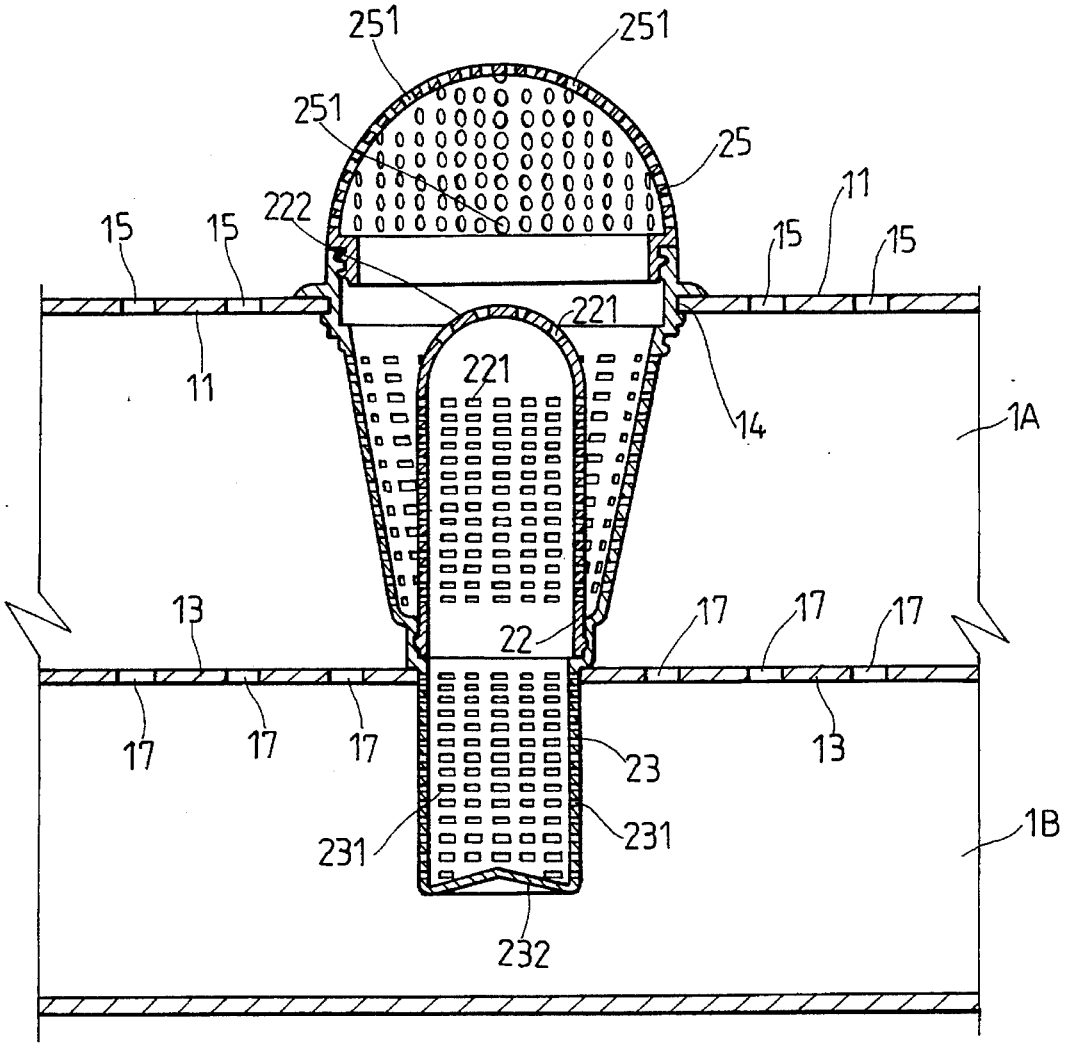
FIG. 4 is a sectional view of a third preferred embodiment according to the present invention.

FIG. 4 shows a third preferred embodiment of the present invention wherein the outer housing 24 is omitted.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An acoustic board comprising:

a front panel formed with a plurality of large openings and small openings;

a rear panel having a distance from said front panel;

an intermediate panel fitted between said front panel and said rear panel thereby forming a front chamber between said front panel and said intermediate panel and a rear chamber between said intermediate panel and said rear panel and having a plurality of large holes and small holes; and a plurality of sound collecting devices each including a conical hood, a cover, an outer housing and a front silencer, said conical hood having a large end engaged with one of the large openings of said front panel and provided at a small end with a rear silencer which has a plurality of perforations and extends through one of the large holes of said intermediate panel into said rear chamber, said cover being engaged with the large end of said conical hood, said outer housing being fitted over said conical hood within said front chamber, said front silencer being fitted within said conical hood and positioned on said rear silencer.

2. The acoustic board as claimed in claim 1, wherein said front chamber and said rear chamber are filled with acoustic absorption material.

* * * * *